United States Patent [19]

Gisler et al.

[11] Patent Number: 4,841,856

[45] Date of Patent: Jun. 27, 1989

[54] PYROTECHNICAL DELAY ELEMENTS FOR DELAYED-ACTION FUSE AND USES THEREOF

[75] Inventors: Anton Gisler, Hilterfingen; Walter Rauber, Gwatt, both of Switzerland

[73] Assignee: Schweizerische Eidgeno-senschaft vertreten durch die Eidg. Munitionsfabrik Thun der Gruppe fur Rustungsdienste, Switzerland

[21] Appl. No.: 221,832

[22] Filed: Jul. 20, 1988

[30] Foreign Application Priority Data

Jul. 29, 1987 [CH] Switzerland ..... 02890/87

[51] Int. Cl.[4] ..... F42C 19/12

[52] U.S. Cl. ..... 102/202.13; 102/275.3; 102/322; 149/19.2

[58] Field of Search ..... 149/19.2; 102/322, 202.13, 102/275.3

[56] References Cited

U.S. PATENT DOCUMENTS 3,948,698 4/1976 Elrick et al. ..... 149/19.6
4,017,342 4/1977 Geisler et al. ..... 149/5
4,092,383 5/1978 Reed, Jr. ..... 264/3 C
4,647,628 3/1987 Gautler et al. ..... 149/19.2 X
4,668,313 5/1987 Gautler et al. ..... 149/19.2 X

*Primary Examiner*—Peter A. Nelson
*Attorney, Agent, or Firm*—Wolder, Gross & Yavner

[57] ABSTRACT

A miniaturized delay element was developed for use in medium-and large caliber weapon systems and is realized in a metallic cartridge made of a copper-free light metal. By including a metallic combustible, an oxidant consisting of a halogen-containing high polymer, and metallocenes as sensitizers, an extremely compact and reliable delay element can be produced. By including a detonating charge consisting of an initiating explosive and a metallocene as sensitizer, the delay element can be designed for initiation without darting flame, for striker pins, needles, etc.

Due to its properties, the pyrotechnical delay element is particularly well suited for use in highly delayed charges and/or for daughter projectiles and/or for self-destruction of munitions. The delay times achieved can be experimentally and reproducibly determined between 1 and about 30 sec.

10 Claims, 2 Drawing Sheets

PYROTECHNICAL DELAY ELEMENTS FOR DELAYED-ACTION FUSE AND USES THEREOF

Figure 1:
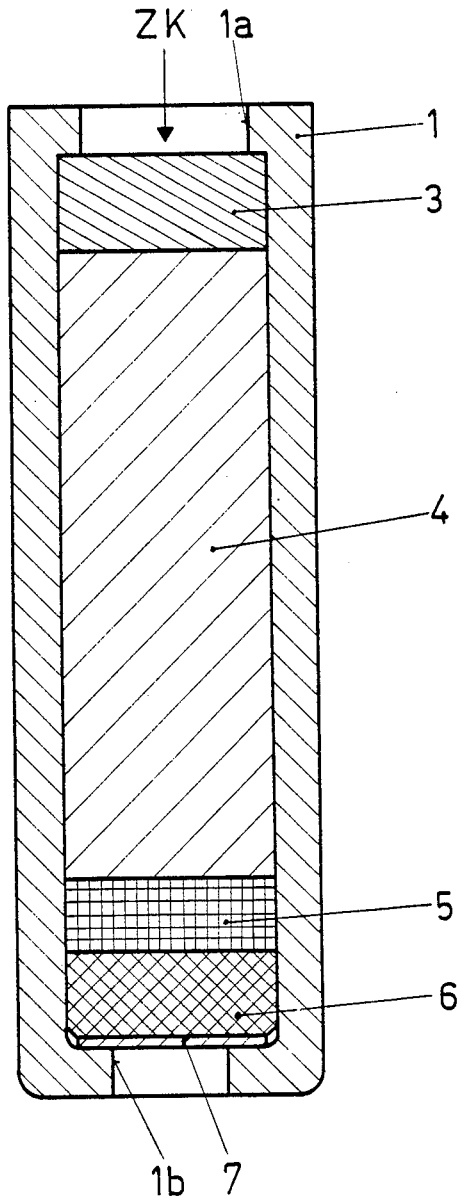

The present invention relates to a pyrotechnical delay element for a delayed-action fuse, comprising at least a booster charge consisting of a combustible and an oxygen carrier, a delay charge consisting of a combustible, an oxygen carrier, a binder medium, a sensitizer and an inert additive, as well as a primer-charge for the main charge, the charges being arranged one behind the other in a cartridge. The invention also relates to preferred uses of the delay element.

Delayed-action fuses and so-called delay charges are known (Rudolf Meyer, "Explosivstoffe", p. 329, 1979, Verlag Chemie). U.S. Pat. No. 3,981,222 discloses a process for the preparation of a delay charge which facilitates delay times of up to 18 seconds per inch of the powder mixture used. Accordingly, known per se coruscative agents are introduced into caps made of glass fiber-reinforced paper and provided, for extension of the combustion path, with baffles. The size of such a cap is, e.g., 1 7/16 inch, at a thickness of 0.2 inch. The delay achieved is 8 sec. The connection between delay time and size permits the use of such caps only in large-caliber weapons and systems.

In pyrotechnics, the use of glass fiber-reinforced paper is frowned upon for releases of safety (ignition due to friction; damage). There is also the danger of the reliability or reproducibility of delay times being compromised due to discontinuous burning caused by heat accumulation in the thermally insulating glass fiber-reinforced paper and by the build-in baffles.

It is therefore one of the objects of the present invention to provide a pyrotechnical delay element which due to its size can also be used in medium-caliber weapons (20 mm diameter and higher); which is highly reliable and achieves fully reproducible delay times even when mass-produced. A further object of the invention is to obviate the need for baffles which are expensive and difficult to produce.

This object is achieved by providing a pyrotechnical delay element comprising at least a booster charge consisting of a combustible and an oxygen carrier, a delay charge consisting of a combustible, an oxygen carrier, a binder, a sensitizer and an inert additive, as well as of a primer charge for the main charge, said charges being arranged one after the other in a cartridge, characterized in that said cartridge is made of a metallic material of high thermal and chemical resistance, and that said delay charge consists of a mixture of a metallic combustible, a halogen-containing, polymerized oxidant and a metallocene as sensitizer.

The solution according to the invention facilitates preparation of delay elements of dimensions suitable for modern ignition caps based on silver azide. The main charges proper consist of high explosive of the known types such as nitro-penta, tetryle, hexogen (RDX), octogene (HMX), octastite, etc.

The delay element as described in the following is mainly intended for weapon systems in which no electric energy is provided for the ignition device.

The delay element is advantageously embodied in the form of a cartridge as defined hereinafter, as such a cartridge, apart from having excellent heat condition, is also highly resistant to chemicals.

The metallocenes mentioned further below have been found particularly suitable as sensitizers.

Found advantageous as oxidants are a number of halogencontaining, high-molecular substances such as the commercially available polytetrafluoroethylene (Teflon®, Hostaflon®) or polymonochlorotrifluoroethylene.

A controlled, additional delay of the burning of the delay charge is achievable by admixing of inert additives as explained further below.

In the delay charge, the oxygen carrier lead chromate, in proportions specified hereinafter, has proved most advantageous.

Uses of the object of the invention as described hereinafter are facilitated by the advantages defined further below.

Initiation of physical processes is rendered simple by use of a pyrotechnical delay element. This is particularly advantageous when due to large forces of acceleration or other interfering factors, mechanical and/or electronic delay elements are unsuitable, or when appropriate energies are not available.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attemmpt is made to show structural details of the invention in more detail than is necessary for a fundamental understanding of the invention, the description taken with the drawings making apparent to those skilled in the art how the several forms of the invention may be embodied in practice.

Figure 2:
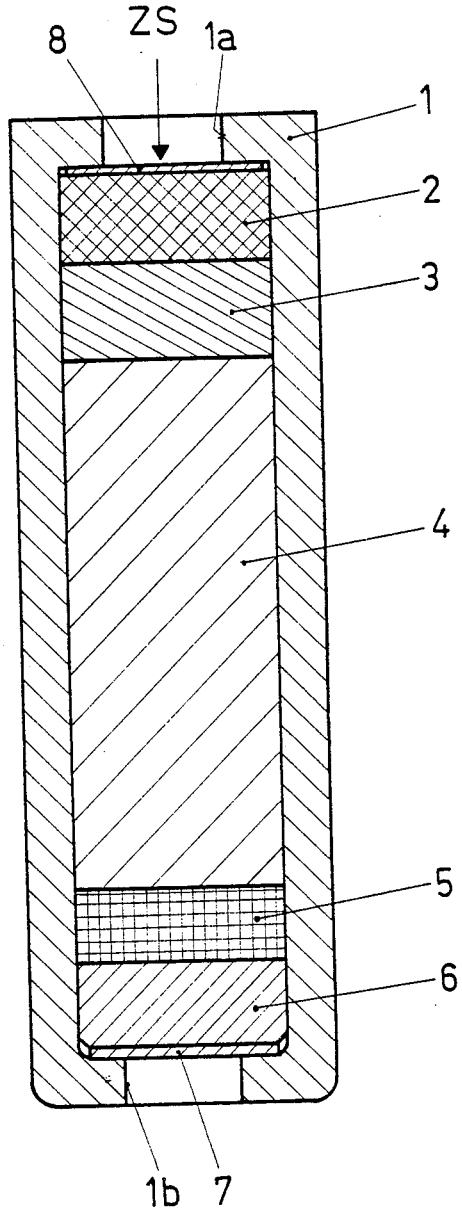

FIG. 1 illustrates a pyrotechnical delay element, suitable in conjunction with an electrically triggered miniature detonating cap, and FIG. 2 shows a delay element comprising a detonator charge for initiation by means of a striker pin.

Referring now to the drawings, there is seen in FIG. 1 a metallic cartridge 1, made of light metal, in which are accommodated, one behind the other, a booster 3, a delay charge 4, and a primer 5 for a main charge 6. This light-metal cartridge 1 is in a known per se manner made of copper-free light metal (DIN 1'725 Nr. 3.0615) and has a diameter of 5 mm. Wall thickness of the cartridge is 0.75 mm and, at the detonator side it is provided with an opening 1*a* in which a commercially available detoninating cap ZK is inserted. At the main-charge side, an opening 1*b* is covered with an obturating disk 7 made of copper-free aluminum and having a thickness of 0.3 mm, which disk, after the delay time has elapsed, bursts due to the pressure wave created and ignites the charge (explosive or bursting charge), not shown, in a manner also known per se.

The booster charge 3 consists of a mixture of silicon, lead chromate, red lead, and nitrocellulose. The silicon, acting as combustible and having a particle size of 25 μm, is present in the booster charge at 30 wt.-%. Lead chromate with 30 wt.-% and red lead with 37 wt.-%, both act as oxygen carier. Nitrocellulose with 3 wt.-% acts as binder.

Preparation of this pulverulent booster charge is effected with components of conventional particle size, which are mixed wet in an acetone solution. Using ultra-sound, this mixture is homogenized and subsequently air-dried, and granulated in the known manner. A granulate size of 0.5 to 0.7 mm, subsequently further dried at 60° C., has been found to be particularly advantageous.

The booster charge is inserted into the cartridge 1 by filling, followed by pressing.

This booster charge ensures the reliable ignition of the adjacent delay charge. In spite of high reaction temperatures, it generates only little gas, protecting the other components from premature ignition.

An above described delay element achieves reproducible delay times of 20 sec, with a deviation of maximum ±0.9 sec, within a series of 100 delay elements.

Preparation of the delay charge 4 is analogous to that of the detonator charge 2 described further below. The result is a very slowly burning delay charge with relatively high reaction temperatures of 350°-650° C. and very low gas yield. The preferred embodiment has as a combustible, tungsten, at 10 wt.-% and lead chromate as oxygen carrier with 77 wt.-%. Nitrocellulose serves as binder with 2 wt.-%. Further provided is ferrocene as sensitizer as 1 wt.-% and polytetrafluoroethylene in its function as oxidant, with 10 wt.-%.

The delay element of FIG. 2 has a structure similar to that of FIG. 1. In this embodiment, a detonating charge 2 is added, covered by means of an obturator disk 8. Instead of a darting flame, a striker needle, a striker pin or the like, caused to smash into the detonating charge 2, is used to initiate ignition. The disk 8, too, is made of copper-free aluminum and has a thickness of 0.1 mm.

It is thus the task of the detonating charge 2 to ensure propagation of the pyrotechnical reaction in the ignition chain, under use of a low energy required for initiation. An optimal powder mixture was found to consist of 40 wt.-% of antimony sulfinde and 6 wt.-% lead rhodanide as friction agents, and 8 wt.-% of calcium silicide as combustible. Furthermore there are provided 40 wt.-% of potassium chlorate as oxygen carrier and 6 wt.-% of tetracene as sensitizer. In a per se known process, these pulverulent components, in their respective commercial particle size of about 10-200 μm, are mixed in a tumbling mixing drum (so-called TURBULA process), after which the mixture is dosed and pressed to the appropriate dimensions. To accmmodate the striker pin or needle, the cartridge 1' is provided with a frontal opening which is smaller than the corresponding opening in FIG. 1.

The following mixture proportions for detonating charges 2 have been found useful:

| | |
|---|---|
| Antimony sulfide: | 30 to 50 wt. % |
| Lead rhodanide: | 5 to 15 wt. % |
| Calcium silicide: | 5 to 10 wt. % |
| Potassium chlorate: | 30 to 50 wt. % |
| Tetracene: | 2 to 7 wt. % |

For the boosters 3 in both delay elements FIG. 1 and FIG. 2, the following mixtures can be used:

| | |
|---|---|
| Silicon: | 10 to 40 wt. % |
| Lead Chromate: | 20 to 40 wt. % |
| Red lead: | 20 to 50% wt. % |
| Nitrocellulose: | 1 to 5 wt. % |

The following mixture proportions may be used for delay charges with long delay times:

| | |
|---|---|
| Tungsten: | 5 to 30 wt. % |
| Lead chromate: | 50 to 80 wt. % |
| Nitrocellulose: | 1 to 4 wt. % |
| Ferrocene: | 1 to 4 wt. % |
| Polytetrafluoroethylene: | 5 to 20 wt. % |

The burning speed of the delay charge can be furthermore predetermined by inert additives like powdered glass, microglobules (glass spherules evacuated or filled with air or an inert gas), barium sulfate, metal salicylates such as copper salicylate and/or sandwich molecules.

Great important in enhancing functional reliability—in spite of its low proportion in the mixture—attaches to the mettalocene acting as sensitizer during the burning of the delay charge as well as in the detonating charge initiated by a striker pin. In addition to, or instead of, ferrocene, the following metallocenes can be successfully used: nickelocene, cobaltocene and ruthenocene.

Experimentally, delay times of between 1 and about 30 sec can be reproducibly determined.

It will be evident to those skilled in the art that the invention is not limited to the details of the foregoing illustrative embodiments and that the present invention may be embodied in other specific forms without departing from the spirit or essential attributes thereof. The present embodiment are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed:

1. A pyrotechnical delay element comprising at least a booster charge consisting of a combustible and an oxygen carrier, a delay charge consisting of a combustible, an oxygen carrier, a binder, a sensitizer and an inert additive, as well as of a primer charge for the main charge, said charges being arranged one after the other in a cartridge, characterized in that said cartridge is made of a metallic material of high thermal and chemical resistance, and that said delay charge consists of a mixture of a metallic combustible, a halogen-containing, polymerized oxidant and a metallocene as sensitizer.

2. A pyrotechnical delay element as claimed in claim 1, further comprising a detonating charge arranged in said metallic cartridge, characterized in that said detonating charge consists of a mixture comprising an initiating explosive, a combustible and a metallocene as sensitizer.

3. The pyrotechnical delay element as claimed in claim 1 or 2, characterized in that said cartridge is made of a copper-free light metal.

4. The pyrotechnical delay element as claimed in claim 1 or 2, characterized in that said sensitizer is selected from the group consisting of ferrocene, nickelocene, cobaltocene and ruthenocene.

5. The pyrotechnical delay element as claimed in claim 1, characterized in that said oxidant is selected from the group consisting of polytetrafluoroethylene and polymonochlorotrifluoroethylene

6. The pyrotechnical delay element as claimed in claim 1, characterized in that to said delay charge are admixed with inert additives selected from powdered glass, glass spherules and barium sulfate.

7. The pyrotechnical delay element as claimed in claim 1, characterized in that to said delay charge is added as oxygen carrier lead chromate at a weight proportion of 50 to 80%.

8. Use of a pyrotechnical delay element according to claim 1 for temporal control of the self-destruction of a projectile, a daughter projectile, or both.

9. Use of a pyrotechnical delay element according to claim 1 for initiating the detonation of an explosive charge of a projectile at the end of its travel time and after its penetrating a target.

10. Use of a pyrotechnical delay element according to claim 1 for initiation of a physical process with predetermined delay time.

* * * * *